United States Patent [19]

Allen

[11] 4,377,096

[45] * Mar. 22, 1983

[54] CORK EXTRACTOR

[75] Inventor: Herbert Allen, Houston, Tex.

[73] Assignee: Hallen Company, Houston, Tex.

[ * ] Notice: The portion of the term of this patent subsequent to Jul. 7, 1998, has been disclaimed.

[21] Appl. No.: 223,170

[22] Filed: Jan. 7, 1981

Related U.S. Application Data

[63] Continuation-in-part of Ser. No. 17,598, Mar. 5, 1979, Pat. No. 4,291,597, which is a continuation-in-part of Ser. No. 925,365, Jul. 17, 1978, Pat. No. 4,276,789.

[51] Int. Cl.[3] ..... B67B 7/00

[52] U.S. Cl. ..... 81/3.38 A

[58] Field of Search ..... 81/3.36-3.38 A, 81/3.48

[56] References Cited

U.S. PATENT DOCUMENTS

| | | | |
|---|---|---|---|
| 32,396 | 5/1861 | Burgess | 81/3.38 A |
| 206,134 | 7/1878 | Richardson et al. | 81/3.37 X |
| 2,496,672 | 2/1950 | Newman | 81/3.38 R X |
| 4,276,789 | 7/1981 | Allen | 81/3.36 |

FOREIGN PATENT DOCUMENTS

| | | | |
|---|---|---|---|
| 120684 | 6/1901 | Switzerland | 81/3.37 |

*Primary Examiner*—James G. Smith

*Attorney, Agent, or Firm*—Browning, Bushman, Zamecki & Anderson

[57] ABSTRACT

The invention comprises a cork extractor including a corkscrew and a guide receiving the corkscrew and permitting longitudinal and rotative movement of the corkscrew. A bottle-engaging device is connected to the guide for positioning the guide and corkscrew in generally coaxial alignment with the neck of the bottle, and this device includes a stop for limiting downward movement of the guide with respect to the bottle. Spacers interconnect the guide and the bottle-engaging device to space the guide upwardly from the bottle-engaging device. The spacers also define an opening for receipt of the cork as it emerges from the bottle. The invention further includes catches adjacent the spacers in the opening engageable with the cork as it emerges from the bottle to prevent rotation of the cork. An abutment carried by the corkscrew limits downward movement of the corkscrew with respect to the guide.

25 Claims, 16 Drawing Figures

FIG. 5
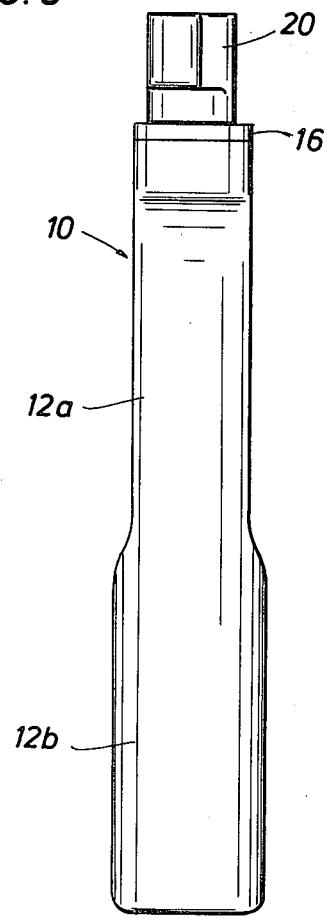
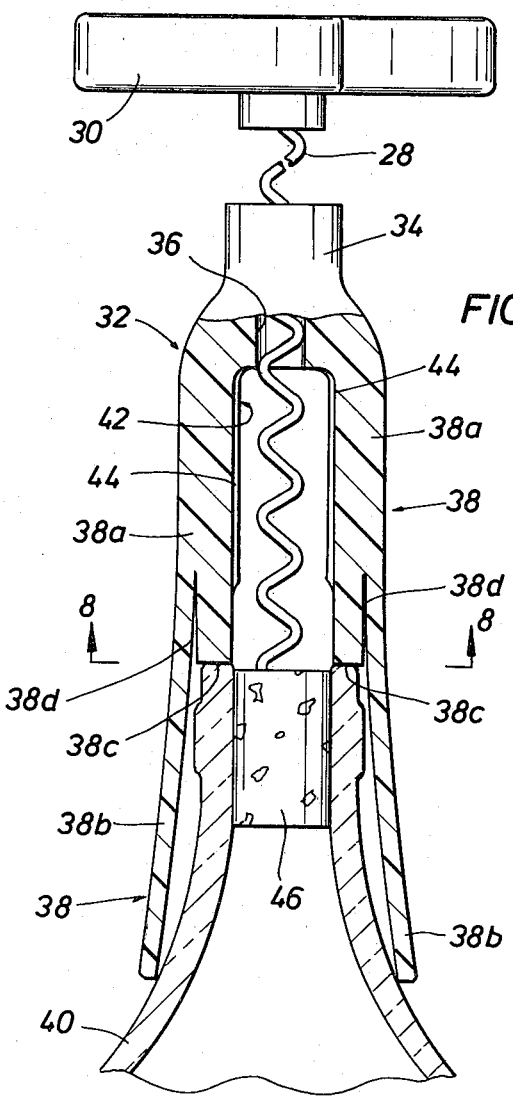
FIG. 7
FIG. 6
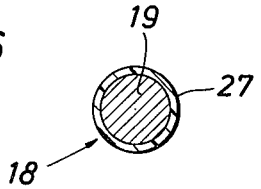
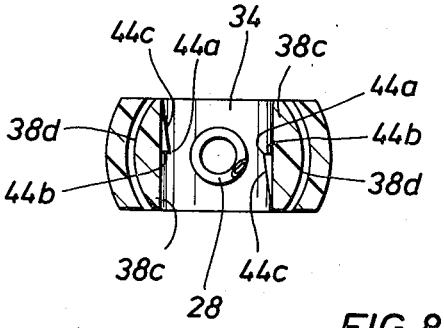
FIG. 8

CORK EXTRACTOR

CROSS REFERENCE TO RELATED APPLICATIONS

This is a continuation-in-part of prior co-pending application Ser. No. 17,598 filed Mar. 5, 1979 now U.S. Pat. No. 4,291,597, which in turn is a continuation-in-part of prior application Ser. No. 925,365 filed July 17, 1978, now U.S. Pat. No. 4,276,789.

BACKGROUND OF THE INVENTION

1. Field of the Invention

The present invention pertains to apparatus for extracting corks from bottles. A number of features are desirable in such an apparatus. One of the most important of these is that the corkscrew portion of the apparatus be well centered in the cork during operation, so as to ensure the removal of the entire cork, and minimize the possibility of breaking the cork and permitting the resulting fragments to fall into the wine in the bottle. Another important consideration is that the corkscrew must be pulled in a substantially straight line along its own axis when the cork is being removed, and this axis should ordinarily be substantially aligned with that of the bottle, so as to facilitate removal. Another desirable feature in cork-extracting apparatus is the provision of means to reduce the manual force required to drive the corkscrew into the cork and/or to extract the cork from the bottle. There is also a need for preventing small cork fragments from breaking off even when the corkscrew is driven completely through the cork.

2. Description of the Prior Art

The prior applications, cross-referenced above, of which this application is a continuation-in-part disclose cork extractors which meet the above needs. These applications describe a simple, inexpensive apparatus for extracting a cork from a bottle as well as an improved corkscrew proper which may be used to advantage in said apparatus as well as in virtually any other type of corkscrew or cork extractor. The apparatus includes a holder and a cork-engaging member. The cork-engaging member includes the corkscrew per se and abutment means, such as a handle, carried on the corkscrew and engageable with the holder to limit downward movement of the cork-engaging member with respect to the holder in use. The holder includes guide means having a guide passageway extending generally longitudinally therethrough. The guide passageway has guide surface means facing generally radially inwardly and is sized to lie closely adjacent the outer diameter of the corkscrew helix, the corkscrew being rotatably and longitudinally movable in the guide passage. The holder further includes stop means engageable with the bottle to limit downward movement of the holder with respect to the bottle as well as grip means spaced downwardly from the guide means and engageable with the bottle to radially align the guide means with the bottle. Thus, the grip means in conjunction with the stop means of the holder serve to generally radially center and coaxially align the guide means, and thus the corkscrew received therein, with the bottle and its cork.

By rotating the cork-engaging member and, at least initially, simultaneously exerting a downward force thereon, the corkscrew may be driven into the cork while still properly centered and aligned therewith by the holder. When the abutment means of the cork-engaging member comes into abutment with the holder, thereby preventing further downward movement of the cork-engaging member, continued rotation of that member in the same direction will cause the cork to rise on the helical corkscrew, the guide means being spaced above the top of the bottle by a sufficient distance to permit such movement.

The corkscrew itself is improved by the provision of a central body, e.g. of high tensile metal, covered by an outer layer of friction-reducing material, such as polytetrafluoroethylene, on at least one portion of the downwardly facing surfaces of the central body. This greatly enhances the ease with which the corkscrew may be driven into the cork. This friction-reducing expedient not only virtually eliminates any problem in easily penetrating a tight cork, but also permits the use of design features in the central body which could not be used without the friction-reducing layer and which themselves enhance the ease of insertion and otherwise improve the corkscrew. Accordingly, the friction-reducing layer on the corkscrew is largely instrumental in making the relatively simple apparatus described above effective in easily penetrating and properly removing even extremely hard and/or tight corks.

The corkscrew also has an improved lower pointed tip portion which is formed in such a way that it eliminates the tendency for small cork fragments to be broken away, even when the corkscrew is driven completely through the cork. This effect is further enhanced by the friction-reducing layer mentioned above so that the possibility of contamination of wine by cork fragments is virtually eliminated.

SUMMARY OF THE INVENTION

The present invention provides further improvements in the general type of cork-extracting apparatus disclosed in the aforementioned prior applications. Like said prior apparatus, that of the present invention comprises a cork-engaging member including a corkscrew and preferably also a handle secured to the upper end of the corkscrew. The apparatus further includes guide means, bottle-engaging means, and spacer means. The guide means receive the corkscrew and permit longitudinal and rotative movement thereof. The bottle-engaging means is connected to the guide means for positioning the guide means and corkscrew in generally coaxial alignment with the neck of the bottle. The bottle-engaging means includes stop means for limiting downward movement of the guide means with respect to the bottle. The spacer means interconnect the guide means and the bottle-engaging means and serve to space the guide means upwardly from the bottle-engaging means to allow for upward movement of the cork. The spacer means also define an opening for receipt of the cork as it emerges from the bottle. Catch means are provided adjacent the spacer means in the cork-receiving opening. These catch means are engagable with the cork as it emerges from the bottle to prevent rotation of the cork. As in the prior apparatus, the handle or some other suitable abutment carried by the corkscrew is engagable with the holder for limiting downward movement of the corkscrew with respect to the guide means.

Thus, like the apparatus of the related prior applications, the apparatus of the present invention is operated by engaging the bottle neck with the bottle-engaging means and exerting a downward force on the corkscrew with simultaneous rotation to begin driving the corkscrew into the cork. Continued rotation of the corkscrew will drive it through the cork, and when the abutment means prevents further downward movement of the corkscrew, the cork will begin to climb upwardly out of the bottle on the corkscrew. The climbing action of the cork is dependent upon the presence of greater frictional forces between the exterior of the cork and the bottle neck than between the corkscrew and the surfaces of the helical passage which it has formed through the cork. Because of the relatively small size of the corkscrew, this relationship is usually maintained at least until the cork has been raised a substantial distance out of the bottle neck, particularly where the corkscrew has the aforementioned friction-reducing coating. However, as the ratio decreases, the cork will begin to turn slightly, albiet at a much slower rate than the corkscrew, as it rises. This subjects the cork to combined shear and tension forces which, on an extremely old or fragile cork, might cause damage. Furthermore, if, after the cork has been raised a substantial distance, the frictional forces between the cork and the bottle neck decrease to less than or equal to those between the cork and the corkscrew, the cork will begin to rotate with the corkscrew and cease moving longitudinally. Should this occur with the basic apparatus as disclosed in said prior applications, removal of the cork is completed by simply pulling upwardly on the holder to draw the lower portion of the cork from the bottle. Ordinarily, this does not require a great amount of force. However, it can be somewhat undesirable in that a novice operator of the apparatus may simply not realize that the last-mentioned action is necessary, but may instead continue to rotate the handle and corkscrew to no avail.

With the improved apparatus of the present invention, by the time the cork has emerged from the bottle neck a sufficient distance to substantially reduce the frictional forces therebetween, the catch means will have engaged the cork to prevent rotation thereof and thus permit the cork to continue moving upwardly on the corkscrew until it is completely removed from the bottle neck. Indeed, the catch means is so effective in preventing rotation of the cork that complete removal can be achieved in the manner described above even if the cork is slightly longer than the opening in the holder into which the cork moves as it emerges from the bottle. In such an instance, when the top of the cork reaches the top of said opening, the cork will compress longitudinally to allow its lower end to continue moving upwardly and out of the bottle.

The catch means define catch surfaces, preferably including sharp edges, which are positioned in the path of travel of the cork as it emerges from the bottle and embeddable in the cork to prevent rotation as explained above. In a preferred embodiment, the catch means project generally radially into the path of travel of the cork for engagement with its sides. These latter catch means may include at least two relatively sharp edges extending generally longitudinally along the sides of the cork-receiving opening. By proper selection of the length of such catch means, it is possible to allow for engagement of even the shortest cork while still providing an opening long enough to accommodate even the longest cork without compression thereof. This has the advantage of minimizing damage to and distortion of the cork, in case it should be desired to reuse it.

Another improvement according to the present invention, which may be used either with or without the aforementioned catch means involves the bottle-engaging portion of the apparatus. As in the apparatus of the prior related applications, the holder includes a pair of generally diametrically opposed and longitudinally extending legs. Shoulders are formed intermediate the ends of these legs for engaging the top of the bottle and thereby limiting downward movement of the holder on the bottle. The portions of the legs extending downwardly from these shoulders form a pair of gripping elements for engaging the neck of the bottle. The opposed, radially inner surfaces of these gripping elements are concave inwardly, and more specifically, define circular arcs when viewed in transverse cross section. In accord with the present invention, the centers of these arcs are offset radially outwardly from the longitudinal centerline of the apparatus. If the radius of these arcs corresponds generally to that of the drip ring of the smallest bottle with which the apparatus is expected to be used, this expedient provides for engagement of each gripping element with the grip ring of virtually any size bottle at at least two points while still permitting the inclusion of a relatively large shoulder surface area for engagement with the top of the bottle. These factors in turn provide more stable seating of the holder on the bottle.

In another improvement according to the invention, connection means join the corkscrew and the holder. The connection means is mounted for longitudinal but generally non-rotative movement on the holder, the corkscrew in turn being mounted in the connection means for rotative but generally non-longitudinal movement. In these embodiments, the connection means may include rails having longitudinal slots for receiving pins on the holder. In use, as the guide means move downwardly with the corkscrew as it is being driven into the cork, the rails move into the cork-receiving opening, and their side edges are positioned to serve as the longitudinally extending edges of the catch surfaces. The edges of the slots in the rails may also serve this function.

In the preferred embodiments wherein the holder includes a pair of legs extending downwardly from the guide means, with the upper portions of the legs forming the spacer means and the lower portions of the legs forming the bottle gripping elements, emplacement of the holder on a very large necked bottle can cause substantial radial deflection not only of the gripping elements but also of the spacer means. Then, if the catch means are formed on the spacer means and project radially inwardly therefrom, such deflection might interfere with proper engagement of the cork by the catch means. This can also occur with bottles of an unusual shape, e.g. bottles having relatively short necks which flare outwardly quite near the top. To ensure effective operation of the catch means in such cases, and in accord with still another modification of the invention, each of the legs may have a longitudinal split extending upwardly from the shoulder which abuts the top of the bottle. The radially outer portion of the spacer elements can then be deflected radially outwardly from the inner portion adjacent such split while the radially inner portion of the leg above the shoulder remains in an undeflected position. Thus, the catch means which are carried on said radially inner portion remain in proper position to engage the cork when it has emerged the desired distance from the bottle neck.

It is therefore a principal object of the present invention to provide an improved cork-extracting apparatus including catch means engagable with the cork as it emerges from the bottle to prevent rotation of the cork.

Another object of the present invention is to provide such an apparatus which may be used with corks of various lengths.

Still another object of the present invention is to provide such an apparatus wherein the catch means may properly engage a cork even though a relatively wide bottle neck is engaged by the bottle engaging means.

Still another object of the present invention is to provide such an apparatus having means for ejecting the cork therefrom.

A further object of the present invention is to provide such an apparatus with improved means for stabilizing the holder thereof on a conventional wine bottle neck.

Still other objects, features, and advantages of the present invention will be made apparent by the following detailed description of the preferred embodiments, the drawings, and the claims.

BRIEF DESCRIPTION OF THE DRAWINGS

FIG. 5 is a side elevational view taken along the line 5—5 in FIG. 2.

FIG. 6 is a detailed sectional view through the corkscrew taken along the line 6—6 in FIG. 1.

FIG. 7 is a view similar to that of FIG. 1 of a second embodiment of cork-extracting apparatus.

FIG. 8 is a transverse cross-sectional view taken along the line 8—8 in FIG. 7.

DESCRIPTION OF THE PREFERRED EMBODIMENTS

Figure 4:
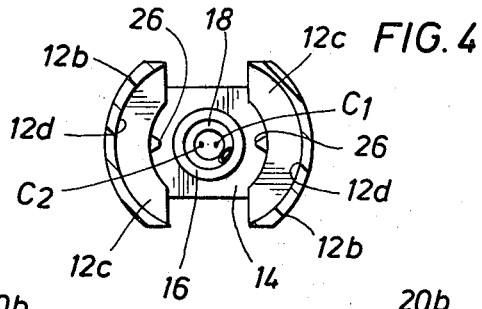
FIG. 4 is a transverse cross-sectional view taken along the line 4—4 in FIG. 1.

FIGS. 1–6 illustrate a first embodiment of cork extracting apparatus according to the invention. The apparatus generally comprises two main portions, namely a holder and a cork-engaging member. The holder includes a main body member 10 which, in the embodiment shown, is integrally molded from a suitable plastic. The main body member 10 includes a pair of diametrically opposed, circumferentially spaced apart, longitudinally extending flexible legs 12, each of which comprises an upper portion **12*a* and a lower portion 12*b*. The main body member 10 of the holder includes an annulus 14 interconnecting and extending upwardly from the upper ends of legs 12. Annulus 14 serves as the foundation portion of the guide means of the holder, said guide means further including a bushing member 16 rigidly mounted within annulus 14 in any suitable manner. Bushing member 16 is preferably formed of a friction-reducing material such as polytetrafluoroethylene and is in the form of a sleeve which extends longitudinally along the inner surface of annulus 14 and has an annular flange extending radially outwardly from the upper end and abutting the uppermost surface of annulus 14**. It is noted that, as used herein, terms such as "upper," "lower," "upwardly," and "downwardly" refer to the apparatus as shown in the drawings and as it would be positioned for use on an upright bottle. Such terms are used for convenience, and should not be construed in a limiting sense. Also, terms such as "radial," "longitudinal," "circumferential," etc. are used with reference to the corkscrew when in place in the holder unless otherwise noted.

The other major portion of the cork-extracting apparatus is a cork-engaging member including a helical corkscrew 18 and a handle 20. The corkscrew 18 serves as the guide portion of the cork-engaging member and is removably receivable in bushing 16 of the guide means of the holder. Corkscrew 18 is longitudinally movable in the bore defined by surface **16*a* either with or without simultaneous rotation. The outer diameter of the helix of corkscrew 18 is sized to lie closely adjacent the cylindrical radially inwardly facing surface 16*a* of the bushing 16 of the guide means. Additionally, the length of cylindrical surface 16*a* is at least as long as, and preferably longer than, the pitch of the helix of corkscrew 18. Accordingly, surface 16*a* serves as the guide surface of the holder, defining a guide passageway for corkscrew 18 and maintaining it in substantial coaxial alignment with the guide means 14, 16**.

The handle 20 includes a lowermost annular hub **20*a* and a pair of diametrically opposed radially extending arms 20*b*. Hub 20*a* is sized and positioned to abut the upper surface of bushing 16 as corkscrew 18 moves downwardwardly therein to thereby limit downward movement of the cork-engaging member 18, 20 with respect to the holder 12, 14, 16**.

Figure 1:
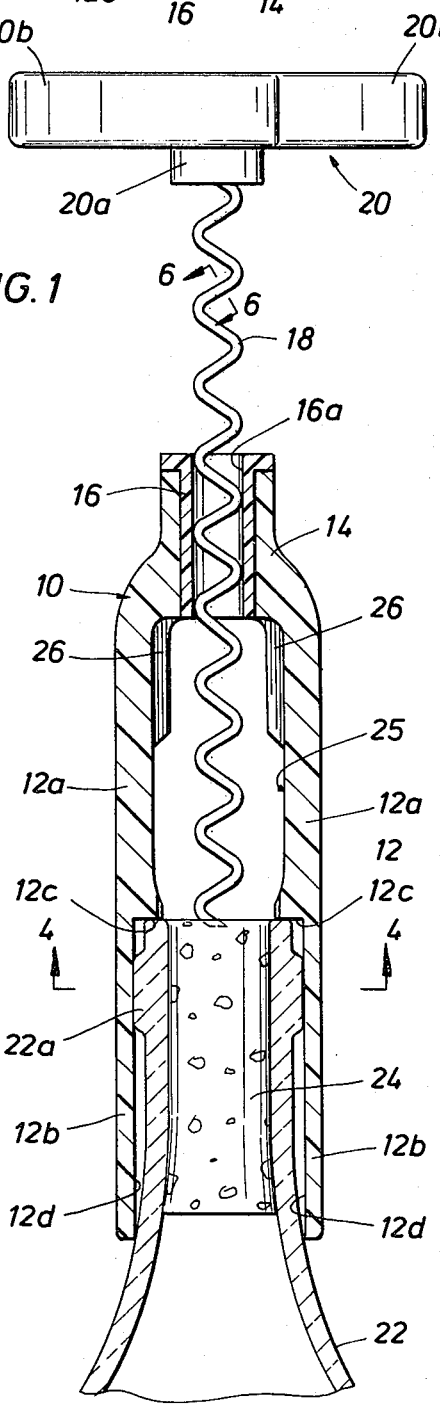
FIG. 1 is a longitudinal cross-sectional view of a first embodiment of cork-extracting apparatus in operating position on a bottle neck and with some parts being shown in elevation.

To use the apparatus, the holder 12, 14, 16 is emplaced over the top of the bottle 22. Legs 12 have respective opposed radially inner surfaces, and each of the legs 12 had a downwardly facing shoulder **12*c* on its inner surface adjacent the juncture of the upper and lower portions 12*a* and 12*b* respectively of the leg. The shoulders 12*c* lie in a common plane transverse to the longitudinal axis of the holder. Thus, the shoulders 12*c* define stop means which abut the top of the bottle 22 and thereby limit downward movement of the holder with respect thereto. Accordingly, when the holder has been thus placed on the bottle 22, as shown in FIG. 1, the holder legs 12 are positioned with the upper portions 12*a* thereof extending upwardly from the top of the bottle 22. Upper leg portions 12*a* thus serve as spacer means spacing the guide means 14, 16 from lower leg portions 12*b* and from the top of the bottle. A cork-receiving opening 25** is formed between the upper portions 12*a* of the two holder legs for receiving the cork 24 as it emerges from bottle 22.

Figure 2:
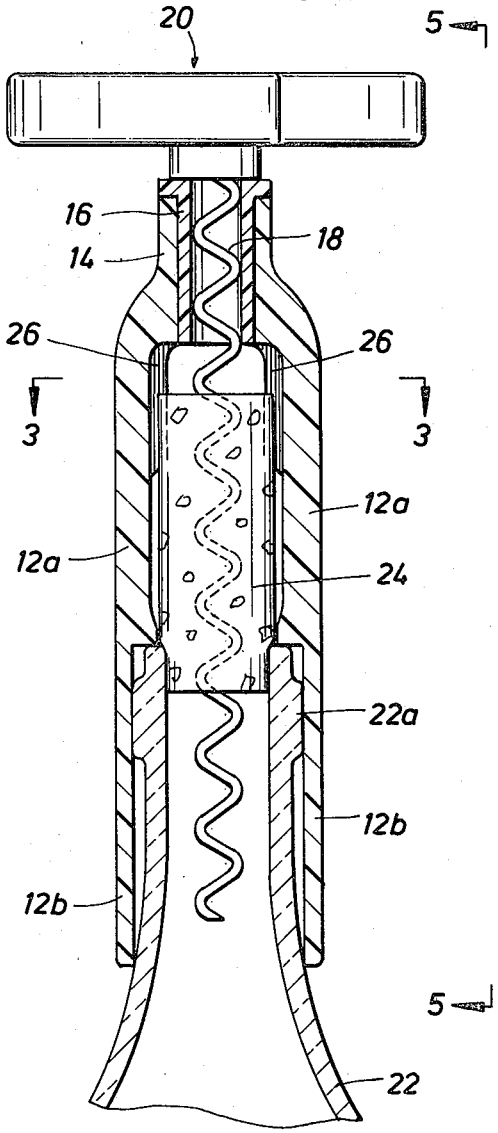
FIG. 2 is a view similar to FIG. 1 showing the apparatus at a subsequent stage of the cork extracting process.

The lower portions 12*b* of holder legs 12 extend downwardly along the neck of bottle 22. These portions 12*b* serve as the gripping elements of the holder. Legs 12 are formed of a suitable lightweight material such as plastic, aluminum, or the like and have sufficient inherent flexibility and resiliency to permit gripping elements 12*b* to be flexed either inwardly or outwardly from the radially unflexed position shown in FIG. 1. Thus, the gripping elements 12*b* may be grasped and squeezed inwardly by the user with one hand to grip the neck of bottle 22 and firmly position the holder thereon. The apparatus as shown in FIGS. 1 and 2 is sized to engage bottle 22 without substantial flexing of legs 12. However, the flexibility of holder legs 12 also permits the holder to accommodate bottles of larger or smaller neck diameters. Gripping elements 12*b*, along with shoulders 12*c* form the bottle-engaging means of the apparatus.

Because holder legs 12 are formed of the same material, are substantially identical in size and configuration, and are symmetrically positioned with respect to annulus 14, they are substantially equally biased to the normal unflexed radial position shown in FIG. 1. Accordingly, when they are urged radially inwardly by the user, they tend to maintain the guide means 14, 16 in a position which is substantially centered with respect to the bottle 22 and its cork 24, even if the diameter of the drip ring 22*a* of the bottle neck differs from the distance between the adjacent portions of the gripping elements 12*b*. Furthermore, such equal resilient biasing further helps to prevent canting of the holder on the bottle and thereby maintain the axis of the guide means 14, 16 substantially coaxially aligned with that of the bottle 22. However, the apparatus is provided with additional features for even more positive stabilizing of the holder on the bottle.

When the gripping elements are thus employed, they will engage and grip the bottle neck at least at the drip ring 22*a*. It is primarily the flexibility of the upper portions or spacer means 12*a* of the holder legs which permits radial flexing of gripping elements 12*b* to accommodate drip rings of differing sizes. However, gripping elements 12*b* are additionally flexible and resilient within themselves. Thus, depending upon the diameter of the bottle to be gripped and the length and degree of flexibility of gripping elements 12*b*, the lower ends of the gripping elements 12*b* may be flexed inwardly to further engage and grip the bottle neck at a second location spaced downwardly from drip ring 22*a*. It has been observed that the tapered necks of most wine bottles reach an outer diameter approximately equal to that of their drip rings at a location around 2 to 2.5 inches (about 5 to 6.5 cm.) below the top of the bottle. The inner surfaces of gripping elements 12*b* have portions 12*d* which, when legs 12 are in their unflexed position as shown, lie straight with respect to the longitudinal axis of the apparatus. Accordingly, if surfaces 12*d* of the gripping elements 12*b* are about 2 to 2.5 inches long, the aforementioned double gripping action may be more readily achieved with a minimum of distortion of the gripping elements. Such gripping action in turn provides a high degree of stability to prevent wobbling of the holder on the bottle. In any event, it is desirable to make the gripping elements 12*b* at least long enough to enable the user to firmly grip the holder in an area primarily surrounding and aligned with the bottle neck, as opposed to an area located generally thereabove.

Even where the aforementioned double gripping is not possible, due to the size of the bottle and/or the length of gripping elements 12*b*, proper alignment of the guide means 14, 16 with the cork 24 can still be maintained by the combined action of engaging the upper edge of bottle 22 with shoulders 12*c* and gripping drip ring 22*a* with gripping elements 12*b*. Referring to FIG. 4, it can be seen that the opposed inner surfaces 12*d* of gripping elements of 12*b*, when viewed in transverse cross section, define circular arcs. However, the centers of the arcs, located at C1 and C2 respectively, are not coincident with the longitudinal centerline of the apparatus, but rather are offset radially outwardly therefrom. It can be seen that, if the radius of the arcs defined by surfaces 12*d* were relatively large, then in gripping a relatively small diameter drip ring, each of such surfaces would essentially have only point contact with the drip ring. Accordingly, it is preferable to choose an arc radius for surfaces 12*d* which generally corresponds to that of the drip ring of the smallest size bottle with which the apparatus is expected to be used. A radius of 1-3/16 inches (3.016 cm) has been found suitable for average use.

When the holder is placed on a relatively small bottle, in which the radius of curvature of the drip ring corresponds generally to that of the arcs defined by surfaces 12*d*, and the gripping elements 12*b* are urged radially inwardly to grip the bottle, surfaces 12*d* will engage the drip ring over substantially their full circumferential extent. This provides a high degree of stability of the holder on the bottle, particularly when coupled with the engagement of the bottle top with the substantially planar surfaces defined by shoulders 12*c*. If a larger bottle is engaged, the surfaces 12*d*, having a smaller radius than the bottle drip ring, will each engage that drip ring at at least two points, again providing greater stability than with an oversized arc. The offsetting of the centers of the arcs defined by surfaces 12*d* allows the use of the relatively small radius in those arcs, with the aforementioned advantages in holder stability, while avoiding both undue reduction in the surface area provided by shoulders 12*c* and the need to deflect legs 12*b* radially outwardly in order to grip an ordinary size bottle.

Referring to FIGS. 1 and 2 together, the operation of the cork extractor is as follows. After the holder has been emplaced on the bottle as shown in FIG. 1 and described hereinabove, the corkscrew 18 is inserted in the bushing 16 so that its lower end abuts the top of the cork 24. The user grasps gripping elements 12*b* with one hand urging them radially inwardly and downwardly to grip the bottle neck. With the other hand, the user grasps the handle 20 and rotates the cork-engaging member 18, 20 clockwise as viewed from the top while simultaneously bearing downwardly on it to begin driving the corkscrew 18 into the cork. After the corkscrew 18 has started into the cork, it can be driven farther into and through the cork by continued rotation without the need to exert downward force.

The length of the corkscrew 18 is such that when hub 20*a* comes into engagement with the upper surface of bushing 16 thereby limiting further downward movement of the cork-engaging member, the corkscrew 18 ordinarily will have been driven through the lower end of cork 24. With a larger cork, the screw may not pass through the lower end of the cork when the cork-engaging member ceases its downward movement. However, it will, in any event, have penetrated a substantial portion of the length of the cork. The user then continues to rotate the cork-engaging member 18, 20 in the same direction. Since the abutment of hub 20*a* with bushing 16 prevents further downward movement of the cork-engaging member, such rotation will cause cork 24 to climb upwardly on the corkscrew 18.

The climbing movement of cork 24 as described above is possible due to the presence of greater frictional forces between the exterior of cork 24 and the interior of the neck of bottle 22 than those between corkscrew 18 and cork 24. In order to facilitate the driving of corkscrew 18 into cork 24, and also to ensure low enough frictional forces therebetween to permit a substantial climbing of the cork, corkscrew 18 is comprised of a wire or central body 19 coated with a layer 27 of friction-reducing material, as shown in FIG. 6. The friction-reducing material of layer 27 may comprise polytetrafluoroethylene or any other suitable material bonded to central body 19 by techniques known in the art. As used herein, the term "friction-reducing" will be construed to cover any material which reduces the friction between the corkscrew and the cork to a significantly greater degree than could be achieved by merely polishing the central body. Although polytetrafluoroethylene, and similar plastics, produce particularly striking results, other materials such as silicone coatings could also be used.

The coating 27 sufficiently reduces the friction between corkscrew 18 and cork 24 that it will remain less than that between the cork and bottle neck until the cork has been raised almost completely out of the bottle neck, e.g. to at least about the position shown in FIG. 2. However, as the cork rises, thereby decreasing the amount of contact area between the cork and the bottle neck and therefore the relative friction between those surfaces as compared to that between the cork and the corkscrew, the cork will, in the absence of preventative measures, begin to rotate slightly. However, as long as the friction between the cork and bottle neck remains significantly greater than that between the cork and corkscrew, such rotation of the cork will be at a relatively slower rate than that of the corkscrew, and the cork will continue to rise. This rotation is not ordinarily a problem. However, in the case of an extremely old, fragile, and/or damaged cork, which is placed under combined shear and tension loads by the aforementioned movements, some breakage or the like could occur.

Furthermore, when a cork has risen to about the position shown in FIG. 2, if the amount of surface area of cork 24 in contact with the bottle neck is reduced so that the friction between the cork and corkscrew begins to exceed that between the cork and the bottle neck, the cork would, in the absence of the catch means to be described below, simply begin rotating in the bottle neck along with the corkscrew and cease moving longitudinally. The amount of cork remaining in the bottle neck at that point would be so small that removal could be completed by simply lifting up on holder 10 with relatively little effort. However, this simple expedient may not be readily apparent to all users. In any event, it does slightly complicate what would otherwise be an essentially one step process whereby the cork could be completely removed by continued rotation of handle 20 in the same direction.

Accordingly, the present invention provides catch means on holder 10 in the cork-receiving opening 25 for engaging the cork as it emerges from the bottle neck and preventing rotation thereof. In the embodiment of FIGS. 1–6, the catch means are in the form of a pair of projections 26 each integrally formed on the radially inner surface of a respective one of the spacer elements 12*a*. The distance between spacer elements 12*a* is approximately equal to the outer diameter of a standard wine cork. Thus, insofar as they project radially inwardly from spacer elements 12*a* into the cork-receiving opening 25, projections 26 extend into the path of travel of cork 24 as it emerges from bottle 22. Projections 26 extend longitudinally along the upper portion of opening 25. Because the projections 26 extend longitudinally along opening 25, they can, if sufficiently long, engage the shortest of corks even though the length of opening 25 is sufficient to accommodate the longest corks. Furthermore, sufficiently long catch means can engage a cork soon enough in the extraction process to prevent any substantial rotation thereof and thereby prevent damage to a fragile cork. With a cork-receiving opening 25 of about 2 inches (5.08 cm in length) projections 26 extending downwardly to about 1¼ inch (3.18 cm) from the bottom of opening 25, i.e. from shoulders 12*c* have been found acceptable.

Figure 3:
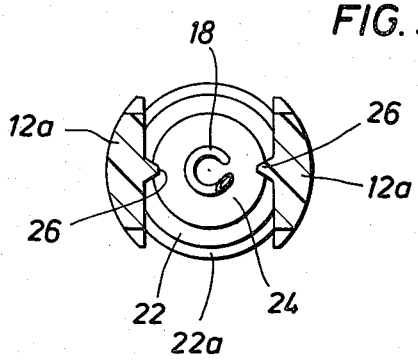
FIG. 3 is a transverse cross-sectional view taken on the line 3—3 of FIG. 2.

As best seen in FIG. 3, projections 26 form a pair of diametrically opposed sharp edges extending longitudinally along opening 25 for embedment into cork 24. Each projection 26 is symmetrical about a radius of the apparatus. Thus, projections 26 tend to resist rotation of cork 24 in both clockwise and counterclockwise directions, as viewed in FIG. 3.

Accordingly, when cork 24 has emerged a substantial distance from the neck of bottle 22, as shown in FIG. 2, its upper end will be engaged by catch means 26. This prevents rotation of cork 24 so that, when it emerges to the point where its frictional engagement with bottle 22 provides insufficient resistance to rotation of the cork, the catch means will take over this function permitting the cork to continue to climb upwardly on corkscrew 18 as described above until it is completely removed from bottle 22.

The extractor apparatus can then be used to assist in removal of cork 24 from the corkscrew 18. By grasping the holder legs 12 and urging them radially inwardly, the user can grip the cork 24 with projections 26. He can then rotate handle 20 in a direction opposite to that used to initially drive the corkscrew 18 into cork 24 while continuing to urge handle 20 against holder 10. Since projections 26 will prevent cork 24 from rotating with the corkscrew, this will cause cork 24 to move downwardly on the corkscrew to partially eject it therefrom. The cork can then simply be gripped by the user's fingers through the space between legs 12, the corkscrew unthreaded therefrom, and the cork removed from the holder.

From the foregoing it can be seen that the apparatus of FIGS. 1–6 provides a relatively simple and economical means by which a user can easily and accurately guide the corkscrew into the cork in a centered and coaxially aligned orientation. The holder of the apparatus permits the user to get a firm grip on the bottle while maintaining the guide means steadily aligned with the cork. The guide means in turn properly directs the corkscrew by guiding it via the O.D. of its own helix. Furthermore, it can be seen that the apparatus substantially reduces the force which must be exerted in extracting the cork from the bottle.

The fact that the cork-engaging member 18, 20 is removable from the holder results in additional advantages. Not only does this removability permit the cork-engaging member to be used as an ordinary corkscrew, if and when desired, but also allows the sharp end portion thereof to be used to sever the foil covering the top of the bottle before removal of the cork. Furthermore, the separability of the two major portions of the apparatus permits both portions to be more easily cleaned and permits one cork-engaging member 18, 20 to be used alternatively with different holders.

The friction-reducing coating 27 has been found to dramatically increase the ease with which the corkscrew may be driven into a cork as well as the ease with which the cork is pulled from the bottle. Indeed, the reduction in friction is so great as to permit the use, in central body 19, of design features and parameters which would not be practicable without layer 27. For example, the wire of which body 19 is formed may be thinner than in conventional screws, and a wider range of helix leads is available. Such design features in turn may even further enhance the ease of operation. Thus, for example, the use of layer 27, especially in cooperation with other friction-reducing features made possible thereby, substantially ensures the capability of removing even a cork which is relatively hard and/or tightly engaged in the bottle neck, and even though the central body 19 of the corkscrew might be so flexible that it would, in the absence of layer 27, be unwound or otherwise distorted in an attempt to drive it into the cork.

FIGS. 7 and 8 show a second embodiment of the invention. It can be seen that, if the holder 10 of FIGS. 1–6 were emplaced on a bottle having an extremely wide neck or an irregularly shaped neck which began to flare outwardly a much shorter distance from the top of the bottle than in most cases, the legs 12, being integral, might be flexed radially outwardly so far as to separate the projections 26 and interfere with their proper engagement with the emerging cork, particularly if the cork were relatively short. Because such wide neck bottles are relatively rare, and because the embodiment of FIGS. 1–6 provides a simple, and therefore attractive and relatively inexpensive holder usable with most wine bottles, this embodiment is generally suitable for most consumer use. However, for those who may have a significant number of occasions to open relatively wide neck bottles, the embodiment of FIGS. 7 and 8 provides for engagement of such bottles without separation of the two projections which form the catch means.

The cork extractor of FIGS. 7 and 8 includes a cork-engaging member comprising a corkscrew 28 and an attached handle 30 substantially identical to those of the first embodiment. This extractor further comprises a holder generally designated by the numeral 32. Holder 32 is substantially identical to holder 10 in general external configuration. However, holder 32 differs from holder 10 in that its guide means is formed by the generally tubular upper portion 34 of the plastic main body of the holder without a separate bushing such as 16 in the first embodiment. Rather, the aperture 36 through portion 34 is sized to slidably receive corkscrew 28 and define the guide surface for aligning the corkscrew with the cork while allowing rotation and longitudinal movement of the corkscrew in the guide means.

Holder 32 also has a pair of diametrically opposed legs 38 integral with and extending downwardly from tubular portion 34. Legs 38 have upper portions **38*a* and lower portions 38*b* with inner, downwardly facing shoulders 38*c* located at the juncture of portions 38*a* and 38*b*. Shoulders 38*c* serve as stop means for abutting the top of a bottle such as 40 whereby portions 38*a* thereabove serve as spacer means for spacing the guide means 34 from the upper end of the bottle. Lower portions 38*b* extend downwardly along the neck of bottle 40 and are radially deflectable whereby they serve as gripping elements for gripping the bottle neck. The upper portions or spacer means 38*a* of legs 38 define a cork-receiving opening 42 therebetween. A pair of opposed radial projections 44 are integrally carried by and extend longitudinally along the upper portions of spacer elements 38*a* whereby they project into the path of travel of cork 46 as it emerges from the bottle. Projections 44 differ from projections 26 of the first embodiment in that they are not symmetrical about radii of the apparatus. Rather, each projection 44 has a sharp edge 44*a* extending generally longitudinally and is formed by a first surface 44*b*, which lies generally in a radial plane with respect to cork 46, and a second surface 44*c*, which intersects surface 44*b* at edge 44*a* and is inclined circumferentially and radially outwardly therefrom. Surfaces 44*b* face in diametrically opposite directions. Thus, projections 44 tend to resist rotation of cork 46 in a clockwise direction, as viewed from the top, more so than in a counterclockwise direction. This configuration, unlike that of projections 26 of the first embodiment, is not intended to provide substantial assistance in ejecting the cork, once it has been removed from the bottle, from the apparatus. However, the configuration of projection 44** offers less impedence to ordinary manual disengagement of the cork from the apparatus.

Legs 38 differ from legs 12 of the first embodiment in that they have splits **38*d* extending longitudinally upwardly from the radially outer extremities of respective shoulders 38*c* to a point intermediate the ends of spacer elements 38*a*. Thus, the portions of spacer elements 38*a* located radially outwardly of splits 38*d* are continuous with gripping elements 38*b* and may be deflected radially outwardly as shown in FIG. 7 to grip a large bottle neck without spreading the radially inner portions of spacer elements 38*a* on which shoulders 38*c* and catch means 44 are formed. Thus, a large bottle such as 40 can be properly gripped while the catch means 44 remain entirely disposed within the path of travel of the emerging cork 46**.

FIGS. 9–12 illustrate a third embodiment of the invention. This embodiment includes a cork-engaging member including a corkscrew 48 and a handle 50 rigidly affixed thereto. The holder 52 is formed of a single piece of molded plastic and includes an upper tubular guide portion 54 having a central cylindrical aperture 56 sized to slidable receive corkscrew 48. A pair of diametrically opposed legs 58 extend downwardly from the guide portion 54. Each leg 58 has an upper portion or spacer element **58*a* for spacing the guide portion upwardly from the top of a bottle 60. Each leg 58 further includes a lower portion 58*b* which extends downwardly along the sides of the bottle neck to form a gripping element. Each leg 58 has a downwardly facing shoulder 58*c* on its inner side at the juncture between the upper and lower portions 58*a* and 58*b* respectively to serve as a stop means for abutting the top of bottle 60. Upper portions or spacer elements 58*a* define a cork-receiving opening 62 therebetween. Since legs 58 are substantially identical to legs 12** of the embodiment of FIGS. 1-6, except for the catch means carried thereby, they will not be described in further detail.

The upper corners of cork-receiving opening 62, defined generally at the juncture between legs 58 and guide portion 54 of the holder, are curved as shown. A pair of recesses or pockets 66 are formed at those corners. Pockets 66 have sharp edges 68 to serve as the catch means of the extractor. While the edges 68 extend somewhat radially into the path of the cork 70 as it emerges from the bottle 60, their longitudinal extent along opening 62 is not very great. However, they do also project generally downwardly into the path of the emerging cork for engagement with its upper end.

Figure 9:
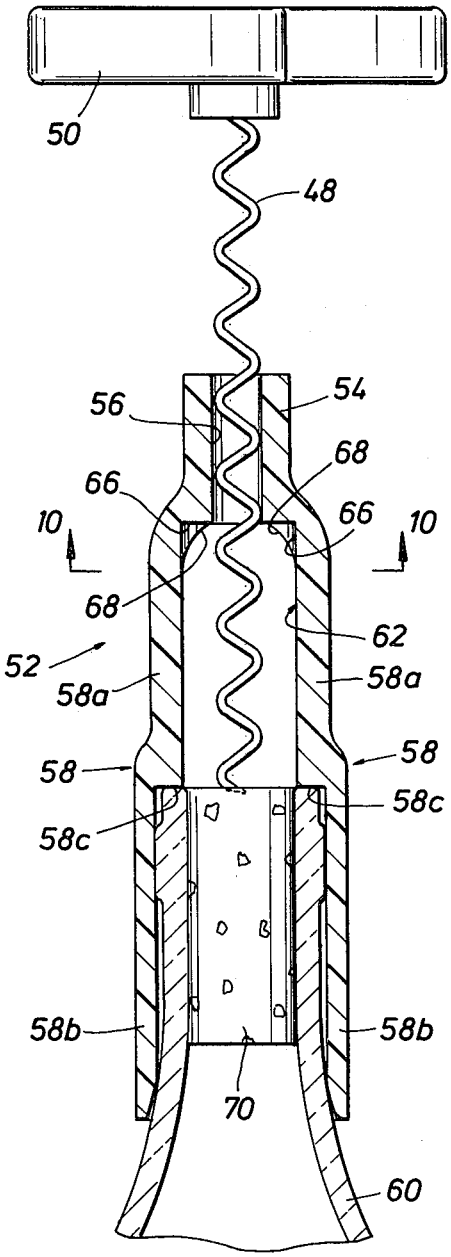
FIG. 9 is a view similar to that of FIG. 1 showing a third embodiment of cork-extracting apparatus.
Figure 11:
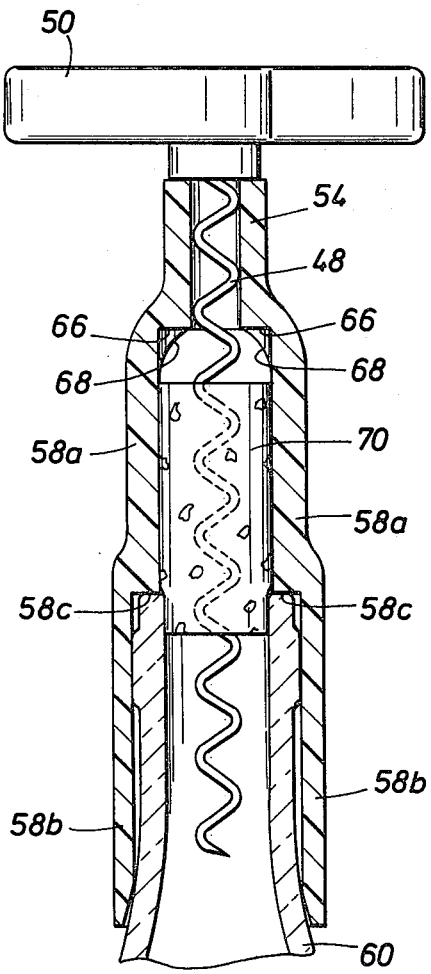
FIG. 11 is a view similar to that of FIG. 9 showing the apparatus in a subsequent stage of the cork extracting process.
Figure 10:
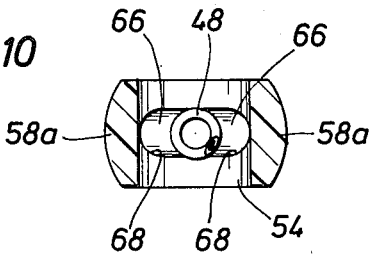
FIG. 10 is a transverse cross-sectional view taken along the line 10—10 in FIG. 9.
Figure 12:
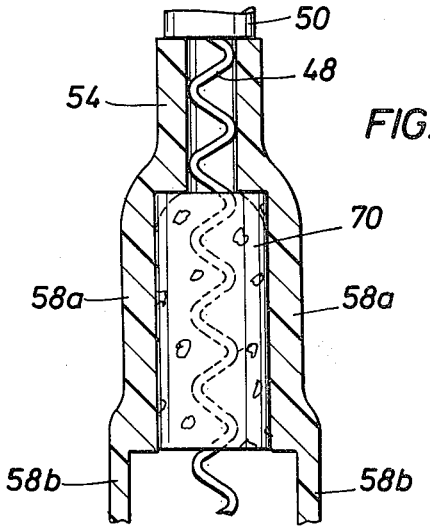
FIG. 12 is a partial longitudinal view similar to those of FIGS. 9 and 11 showing the cork completely removed from the bottle neck.

The operation of the extractor of FIGS. 9-12 is similar to that of the other embodiments described above. FIG. 9 shows the extractor as the corkscrew 48 is just starting into cork 70. FIG. 11 shows the extractor after the corkscrew 48 has been driven downwardly to its full extent and the cork 70 has begun to rise on corkscrew 48. Because of the limited longitudinal extent of catch means 68, whereby their primary engagement is with the end—rather than the sides—of cork 70, the length of opening 62 should be choosen so that even a relatively short cork will have engaged catch means 68 before the frictional resistance to rotation of the cork by the bottle has become insufficient to permit continued climbing action of the cork on the corkscrew 48. Nevertheless, the use of such a short opening will not preclude complete removal of longer corks. This is because, after the upper end of such a long cork has reached the upper extremities of opening 62 and been forced into recesses 66, the resistance to rotation of the cork will be great enough to permit the lower end to continue climbing on the corkscrew 48. The cork will compress longitudinally during such movement, said compression in turn being permitted by the spaces between upper leg portions 58*a* which allow the cork to expand laterally. By comparing FIGS. 11 and 12, it can be seen that a cork longer than window 62 has been compressed into the opening 62 and completely removed from the neck of bottle 60. The same principles can be applied to other types of catch means such as small pointed prongs or the like which might extend downwardly from the guide means of the holder into the cork-receiving opening. Such catch means, again due to their limited longitudinal extent, may not completely prevent rotation of the cork as it rises, but will enable it to be completely extracted by rotation of handle 50.

Referring finally to FIGS. 13-16, a fourth embodiment of the invention is illustrated. In this embodiment, the cork-engaging member is not separable from the holder. Rather, connection means are provided interconnecting the cork-engaging member and the holder. More specifically, the cork-engaging member includes the corkscrew 72 and a carrier 74 rigidly affixed to the upper end of corkscrew 72. Carrier 74 is generally cylindrical but has a radially outwardly extending annular flange 74*a* at its lower end. The cork-engaging member further includes a handle 76 having arms 76*a* and 76*b* and a central hub portion 76*c*. Handle 76 has a central aperture in which the upper portion of carrier 74 is rigidly affixed, as by a suitable adhesive, with flange 74*a* spaced downwardly from the lower end of hub 76*c*. The connection means, generally indicated at 78 includes an uppermost annular portion 78*a*. The opening through annular portion 78*a* is sized to rotatably receive carrier 74. The upper cylindrical portion of carrier 74 is placed through the aperture of annulus 78*a* prior to fixing of carrier 74 to handle 76. The space between hub 76*c* and flange 74*a* is only slightly greater than the thickness of annulus 78*a*. Thus, the cork-engaging member 72, 74, 76 is mounted in connection means 78 for rotative but generally non-longitudinal movement.

Figure 14:
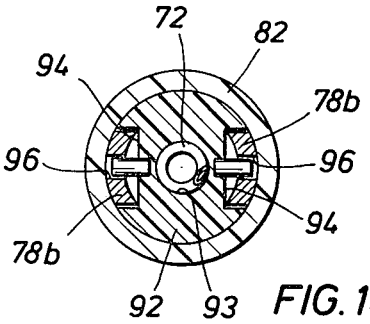
FIG. 14 is a transverse cross-sectional view taken along the line 14—14 in FIG. 13.
Figure 16:
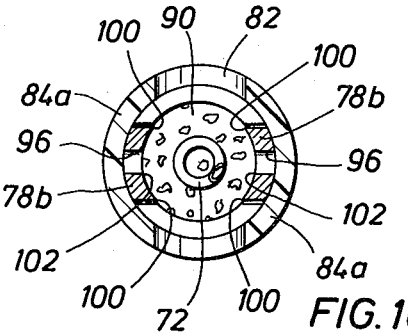
FIG. 16 is a transverse cross-sectional view taken along the line 16—16 in FIG. 15.

Connection means 78 further includes a pair of diametrically opposed rails 78*b* extending downwardly from annular portion 78*a*. As shown in FIGS. 14 and 16, rails 78*b* are arcuate, concave inwardly, in transverse cross section. These rails are spaced apart by a distance slightly less than the diameter of a standard cork.

The apparatus further comprises a holder 80 including a tubular upper portion 82 and a pair of diametrically opposed legs 84 extending downwardly therefrom. The legs 84 have upper portions 84*a* and lower portions 84*b* with inwardly extending flanges 84*c* being formed at the juncture between upper and lower portions 84*a* and 84*b* respectively. Flanges 84*c* define downwardly facing shoulders 84*d* serving as stop means to abut the upper end of a bottle 86. Thus, the upper leg portions 84*a* may serve as spacer elements for spacing tubular portion 82 of holder 80 upwardly from the top of bottle 86, while lower leg portions 84*b* may serve as gripping elements extending downwardly along the sides of the bottle neck.

Upper leg portions or spacer elements 84*a* define an opening 88 therebetween. This opening is wider than the corresponding cork-receiving openings of the preceeding embodiments so as to permit rails 78*b* to move downwardly into the opening 88 in use while still allowing sufficient space for upward movement of cork 90. Flanges 84*c* are also spaced apart by a distance sufficient to allow cork 90 to pass therebetween.

A generally tubular guide member 92 is rigidly fixed within tubular portion 82 as by a suitable adhesive. By comparison of FIGS. 13 and 14, it can be seen that guide member 92 has a pair of longitudinally extending, diametrically opposed, external recesses 94. When guide member 92 is affixed to tubular portion 92, recesses 94 cooperate with the inner diameter of tubular portion 92 to define longitudinal passageways for receipt of rails 78*b*. Thus, the connection means 78 is mounted for longitudinal but generally non-rotative movement on holder 80. To further guide and stabilize connection means 78 in such movement, each rail 78*b* has a longitudinal slot 96. Guide member 92 carries a pair of pins 98 extending radially outwardly in recesses 94 for sliding receipt in respective slots 96.

Figure 13:
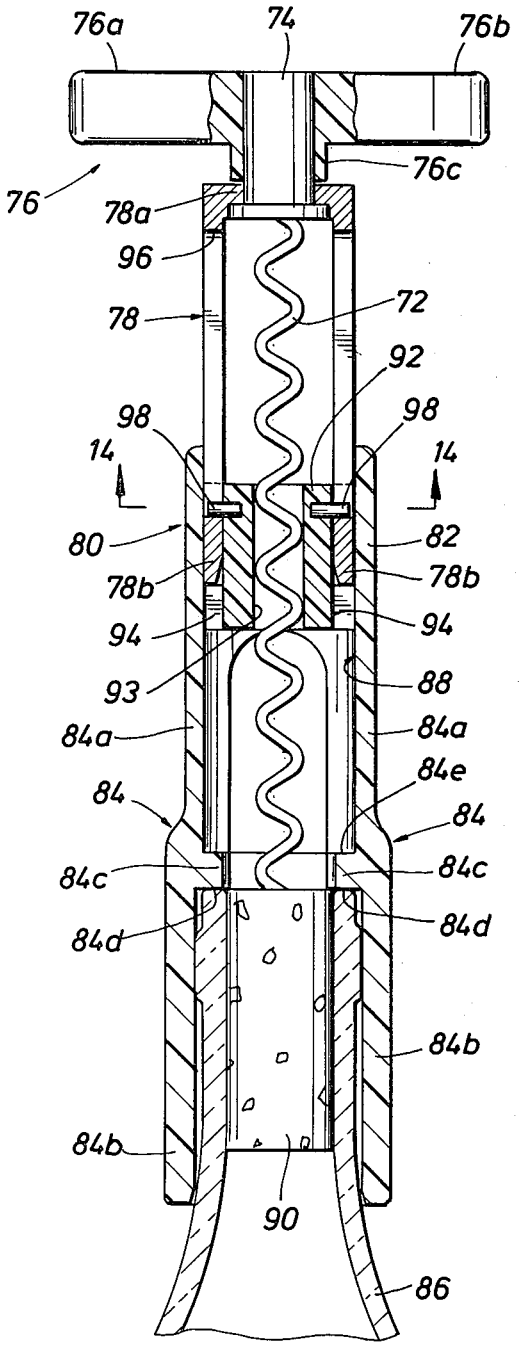
FIG. 13 is a view similar to that of FIG. 1 showing the forth embodiment of cork-extracting apparatus.

In use, the handle 76 is pulled upwardly to raise the interconnected cork-engaging member 72, 74, 76 and connection means 78 to their uppermost position with respect to holder 80, and the holder is emplaced on bottle 86 with shoulders 84*d* abutting the top of the bottle as shown in FIG. 13. The user then squeezes inwardly on gripping elements 84*b* to grip the bottle neck while rotating handle 76 and exerting a slight downward force thereon. Once the point of corkscrew 72 has begun to penetrate cork 90, the downward force may be discontinued and handle 76 is simply rotated. This will drive the corkscrew 72 into and through cork 90. As the corkscrew moves downwardly, the attached connection means 78 will also move downwardly, rails 78*b* moving into opening 88 until their lower ends abut the upwardly facing shoulders 84*e* defined by flanges 84*c*. The rotative mounting of the cork-engaging member in the connection means 78, with the latter in turn being mounted for longitudinal movement on the holder, could suffice to guide and center the corkscrew 72 with respect to cork 90. However, further guidance and stability is provided by the cylindrical passageway 93 in guide member 92 which slidably receives corkscrew 72 for longitudinal and rotative movement.

Figure 15:
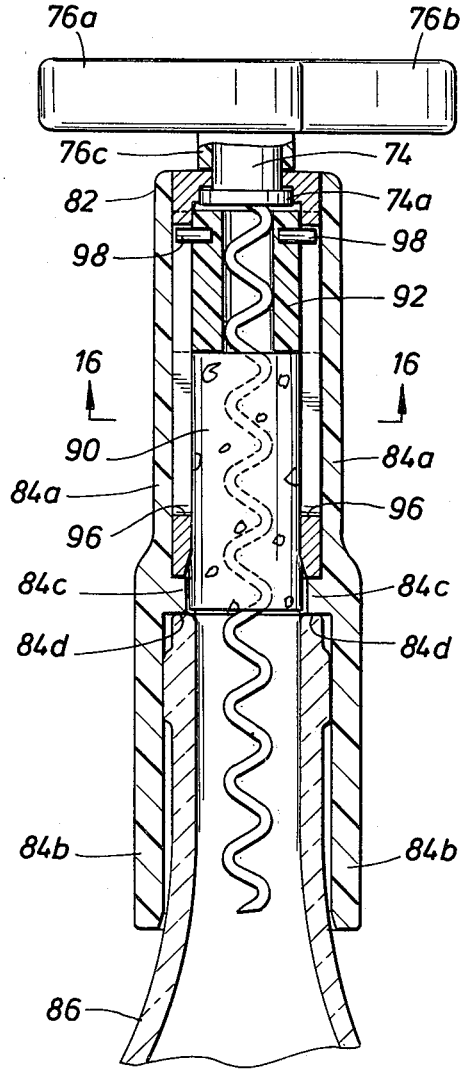
FIG. 15 is a view similar to that of FIG. 13 showing the apparatus in a subsequent stage of the cork extracting process.

After the cork-engaging member and connection means have reached their lowermost position on holder 80, continued rotation of handle 76 will cause cork 90 to climb upwardly on corkscrew 72 as shown in FIG. 15. As previously mentioned, the distance between rails 78*b* of the connection means, which by this time are disposed well within opening 88, is slightly less than the outer diameter of the cork 90. Thus, as shown FIG. 16, the longitudinally extending lateral edges 100 of rails 78*b*, along with the longitudinally extending edges 102 of slots 96, serve as the catch means which embed themselves into cork 90 to prevent rotation thereof. Accordingly, even when the cork has been raised a distance such that the bottle neck 86 no longer offers sufficient frictional resistance to rotation of the cork, such rotation will be prevented by the edges 100 and 102 so that the cork can be completely removed from bottle 86.

Because rails 78*b* and their edges 100 and 102 prevent rotation of cork 90 in both clockwise and counterclockwise directions, the apparatus shown in FIGS. 13–16 can be used to eject cork 90 from such apparatus after the cork has been removed from the bottle. This is accomplished by rotating handle 76 in the opposite direction from that which was used to extract the cork while urging handle 76 downwardly with respect to holder 80. Since longitudinal movement of corkscrew 72 will be prevented by pushing downwardly on handle 76, and rotation of cork 90 will be prevented by catch means 100 and 102, the cork 90 will then be caused to move downwardly on corkscrew 72 with a threading action. Once the cork has moved downwardly to area between gripping elements 84*b*, it can readily be grasped by the user and removal completed either by rotating the cork itself or rotating the handle 76 while pulling upwardly thereon.

Numerous modifications of the preferred embodiments of the invention shown and described herein can be made without departing from the spirit of the invention. For example, the features of the various embodiments shown can be combined and interchanged in numerous ways. Likewise, various features of the prior related applications not repeated herein may be incorporated in apparatus according to the present invention. Accordingly, it is intended that the scope of the invention be defined only by the claims which follow.

I claim:

1. Apparatus for extracting a cork from a bottle comprising:

a corkscrew;

guide means receiving said corkscrew and permitting longitudinal and rotative movement of said corkscrew;

bottle-engaging means connected to said guide means for positioning said guide means and said corkscrew in generally coaxial alignment with the neck of said bottle, said bottle-engaging means including stop means for limiting downward movement of said guide means with respect to said bottle;

spacer means interconnecting said guide means and said bottle engaging means and spacing said guide means upwardly from said bottle engaging means, said spacer means defining an opening for receipt of said cork as it emerges from said bottle;

catch means adjacent said spacer means in said opening engageable with said cork as it emerges from said bottle to prevent rotation of said cork;

and abutment means carried by said corkscrew for limiting downward movement of said corkscrew with respect to said guide means;

said corkscrew being of a length such that, when said abutment means is engaged to so limit downward movement of said corkscrew, said corkscrew extends into said cork receiving opening whereby said cork may move threadedly upwardly on said corkscrew as said corkscrew is rotated to withdraw said cork from said bottle.

2. The apparatus of claim 1 wherein said catch means define catch surfaces positioned in the path of travel of said cork as it emerges from said bottle and embeddable in said cork.

3. The apparatus of claim 2 wherein said catch means project generally radially into the path of travel of said cork for engagement with the sides of said cork.

4. The apparatus of claim 3 wherein said catch surfaces include at least two relatively sharp edges extending generally longitudinally along the sides of said opening.

5. The apparatus of claim 4 wherein said edges extend along the upper portion of said opening and terminate a substantial distance from the lower extremity of said opening.

6. The apparatus of claim 5 wherein said catch means comprise two flanges projecting generally radially inwardly from said spacer means and terminating in said sharp edges.

7. The apparatus of claim 3 including a plurality of legs extending downwardly from said guide means, the upper portions of said legs comprising said spacer means, and the lower portions of said legs comprising said bottle-engaging means.

8. The apparatus of claim 7 wherein said stop means comprise downwardly facing shoulders formed on the radially inner surfaces of said legs adjacent the lower extremity of said spacer means, the portions of said legs below said shoulders comprising radially deflectable gripping elements for engagement with the outer side surface of the neck of said bottle.

9. The apparatus of claim 8 wherein the radially inner surfaces of said gripping elements, in transverse cross section, define respective circular arcs, the respective centers of said arcs being offset radially outwardly from the longitudinal centerline of said apparatus.

10. The apparatus of claim 9 wherein said radially inner surfaces of said gripping elements are, in an unflexed position, disposed generally straight with respect to the longitudinal centerline of said apparatus along at least a major portion of their lengths.

11. The apparatus of claim 8 wherein each of said legs has a longitudinal split extending upwardly from said shoulder, the radially outer portion of said leg being separable from the radially inner portion of said leg adjacent said split.

12. The apparatus of claim 3 comprising a holder including said spacer means and said bottle-engaging means, said apparatus further comprising connection means interconnecting said corkscrew and said holder, said connection means being mounted for longitudinal but generally non-rotative movement on said holder and said corkscrew being mounted for rotative but generally non-longitudinal movement in said connection means.

13. The apparatus of claim 12 wherein said connection means includes a generally tubular portion having said corkscrew rotatably mounted therein and rail means extending downwardly from said tubular portion, said rail means and said holder of said apparatus having interengaging formations connecting said rail means and said holder for relative longitudinal movement, said rail means being so longitudinally movable into said opening and having longitudinally extending edges, said catch means comprising said lateral edges.

14. The apparatus of claim 13 wherein said interengaging formations comprise longitudinal slots in said rail means and pins fixedly mounted on said holder and extending into said slots, said catch means further comprising longitudinally extending edges of said slots.

15. The apparatus of claim 2 wherein said catch means projects generally longitudinally downwardly into the path of travel of said cork for engagement with the upper end of said cork.

16. The apparatus of claim 1 including a pair of legs extending downwardly from said guide means, said stop means comprising downwardly facing shoulders formed on the radially inner surfaces of said legs, portions of said legs above said shoulders comprising said spacer means, and portions of said legs below said shoulders comprising radially deflectable gripping elements for engagement with the outer side surface of the neck of said bottle, and said gripping elements having opposed radially inner surfaces which, when said gripping elements are in an unflexed position, are disposed generally straight with respect to the longitudinal centerline of said apparatus along at least a major portion of their lengths.

17. The apparatus of claim 1 wherein said corkscrew comprises a central body and an outer layer of frictionreducing material.

18. The apparatus of claim 17 wherein said frictionreducing material is polymeric.

19. Apparatus for extracting a cork from a bottle comprising:

a corkscrew;

guide means engagable with said corkscrew and permitting movement of said corkscrew for engaging said cork; and bottle-engaging means connected to said guide means and including stop means for limiting downward movement of said guide means with respect to said bottle, and a pair of radially deflectable gripping elements for engagement with the outer side surface of the neck of said bottle, said gripping elements having opposed radially inner surfaces which, in transverse cross section, define respective circular arcs, the respective centers of said arcs being offset radially outwardly from the longitudinal centerline of said apparatus.

20. The apparatus of claim 19 wherein said radially inner surfaces of said gripping elements are, in an unflexed position, disposed generally straight with respect to the longitudinal centerline of said apparatus along at least a major portion of their lengths.

21. Apparatus for extracting a cork from a bottle comprising:

a corkscrew;

guide means receiving said corkscrew and permitting longitudinal and rotative movement of said corkscrew;

a holder including bottle-engaging means connected to said guide means for positioning said guide means and said corkscrew in generally coaxial alignment with the neck of said bottle, said bottle-engaging means including stop means for limiting downward movement of said guide means with respect to said bottle;

spacer means interconnecting said guide means and said bottle-engaging means and spacing said guide means upwardly from said bottle-engaging means, said spacer means defining an opening for receipt of said cork as it emerges from said bottle;

connection means interconnecting said corkscrew and said holder, said connection means being mounted for longitudinal but generally non-rotative movement on said holder and said corkscrew being mounted for rotative but generally non-longitudinal movement in said connection means; and abutment means carried by said corkscrew for limiting downward movement of said corkscrew with respect to said guide means.

22. The apparatus of claim 21 wherein said connection means includes a generally tubular portion having said corkscrew rotatably mounted therein and rail means extending downwardly from said tubular portion, said rail means and said holder of said apparatus having interengaging formations connecting said rail means and said holder for relative longitudinal movement, said rail means being so longitudinally movable into said opening and having longitudinally extending edges, said edges at least partially comprising catch means engagable with said cork as it emerges from said bottle to prevent rotation of said cork.

23. The apparatus of claim 22 wherein said interengaging formations comprise longitudinal slots in said rail means and pins fixedly mounted on said holder and extending into said slots, said catch means further comprising longitudinally extending edges of said slots.

24. Apparatus for extracting a cork from a bottle comprising:

a corkscrew;

guide means receiving said corkscrew and permitting longitudinal and rotative movement of said corkscrew;

spacer means connected to said guide means and defining a shoulder spaced from said guide means and engageable with said bottle for limiting downward movement of said guide means with respect to said bottle and spacing said guide means upwardly from said bottle, said spacer means further defining an opening for receipt of said cork as it emerges from said bottle;

a plurality of gripping elements connected to said guide means and extending below said shoulder for gripping engagement with said bottle, said gripping elements being resiliently radially deflectable at least partially independently of said spacer means;

and abutment means carried by said corkscrew for limiting downward movement of said corkscrew with respect to said guide means.

25. The apparatus of claim 24 wherein said gripping elements are separable from said spacer means adjacent said shoulder, and wherein said corkscrew is of a length such that, when said abutment means is engaged to so limit downward movement of said corkscrew, said corkscrew extends into said cork receiving opening whereby said cork may move threadedly upwardly on said corkscrew as said corkscrew is rotated to withdraw said cork from said bottle.

* * * * *